US005358071A

United States Patent [19]

Stennett

[11] Patent Number: 5,358,071

[45] Date of Patent: Oct. 25, 1994

[54] GUTTER PROTECTING LADDER ATTACHMENT

[76] Inventor: Arthur R. Stennett, 89 West Ave., Tallmadge, Ohio 44278

[21] Appl. No.: 90,743

[22] Filed: Jul. 13, 1993

[51] Int. Cl.[5] ..... E06C 7/48

[52] U.S. Cl. ..... 182/214; 182/107

[58] Field of Search ..... 248/214, 229, 706, 107, 248/238, 48.2

[56] References Cited

U.S. PATENT DOCUMENTS

| | | | |
|---|---|---|---|
| 3,495,683 | 2/1970 | Broden | 182/116 |
| 3,603,431 | 9/1971 | Nameche | 182/214 X |
| 3,792,570 | 2/1974 | Madison | 182/214 X |
| 4,179,011 | 12/1979 | Morawski | 182/45 |
| 4,369,860 | 1/1983 | Beane | 182/214 |
| 4,445,659 | 5/1984 | LaChance | 248/210 |
| 4,523,733 | 6/1985 | Lunden, Jr. | 248/210 |
| 4,580,660 | 4/1986 | Oling | 182/107 |
| 4,601,365 | 7/1986 | Davis | 182/230 |
| 4,702,446 | 10/1987 | Brown | 248/210 |
| 4,714,136 | 12/1987 | Morin | 248/48.2 X |
| 4,823,912 | 4/1989 | Gould et al. | 182/214 |
| 4,949,810 | 8/1990 | Dwinnell | 182/214 |
| 5,121,814 | 6/1992 | Southern | 182/214 |

FOREIGN PATENT DOCUMENTS

| | | | |
|---|---|---|---|
| 12604761 | 1/1972 | United Kingdom | 182/214 |

*Primary Examiner*—Alvin C. Chin-Shue
*Attorney, Agent, or Firm*—Reese Taylor

[57] ABSTRACT

A ladder support attachment for supporting a ladder relative to a building while avoiding damage to the gutters or eaves trough includes opposed support leges releasably attachable to a transversely extending support rod which is, in turn, receivable within the hollow rung of the ladder. The support legs each have return legs associated therewith and configured to fit within the gutter and bear against the rear wall thereof to enable the ends of the support legs to rest on the roof of the building with the return legs within the gutter and the ladder itself firmly supported but out of contact with the gutter.

7 Claims, 2 Drawing Sheets

GUTTER PROTECTING LADDER ATTACHMENT

BACKGROUND OF THE INVENTION

This invention relates, in general, to support attachments for ladders and relates in particular to a support attachment intended to support a ladder against the roof of a structure while protecting the eaves trough or rain gutter of the structure.

DESCRIPTION OF THE PRIOR ART

It has long been recognized that when supporting ladders against buildings, such as houses, a problem is encountered where those houses have eaves troughs or rain gutters along the edge of the roof. The difficulty is that if the ladder is placed against the eaves troughs themselves, damage can result to the gutter, which is usually made of relatively thin material such as aluminum or vinyl. A further problem is encountered in that the support for the ladder itself is not particularly firm in this instance due to the nature of the gutter material and, therefore, potential safety problems are encountered.

The patent prior art discloses a number of attempts to solve this problem by providing attachments to the ladder. For example, Beane U.S. Pat. No. 4,369,860 discloses a device attached to the ladder inside the uprights of the ladder and having a projecting portion which fits inside the gutter itself. Oling U.S. Pat. No. 4,580,660 shows a stabilizer intended to make line contact with the wall or roof of the structure. Gould U.S. Pat. No. 4,823,912 discloses the utilization of a flat padded board or cross member which engages the side of the house beneath the gutter to keep the ladder away from it. Southern U.S. Pat. No. 5,121,814 discloses a brace intended to be used with the ladder to keep the ladder away from the work surface and is primarily designed for use at the corners of the building.

Several other prior art patents disclose alternative means to protect the gutter and generally involve supports which are placed inside the gutter itself and not necessarily carried by the ladder. Examples can be seen in Davis U.S. Pat. No. 4,601,365 and Morin U.S. Pat. No. 4,714,136.

Of course, there is also considerable prior art showing various attachments which can be supported on a basic ladder structure such as to hold paint cans, etc., and examples can be seen in Broden U.S. Pat. No. 3,495,683, LaChance U.S. Pat. No. 4,445,659, Lunden U.S. Pat. No. 4,523,733 and Brown U.S. Pat. No. 4,702,446.

While the devices disclosed in this prior art are presumably adequate for the purposes for which they are designed, it is felt that a still further improvement can be made by providing a support attachment for use on ladders which will firmly engage the support surface, such as the roof, while protecting the gutter. It is believed that this can be accomplished by providing such a bracket which can be releasably attached to a conventional hollow-rung ladder and which engages the roof surface and also engages the back wall of the gutter thereby firmly supporting the ladder without damaging the gutter.

SUMMARY OF THE INVENTION

It is, therefore, an object of the present invention to provide such a ladder attachment which can be easily attached to an existing ladder and which will provide both firm support for the ladder and protection for the gutter.

It has been found that this object can be achieved by providing a bracket which has opposed elongate legs which can be releasably attached to a support rod passed through the hollow rungs of the ladder.

It has been further found that the support legs can be angled so as to extend in a first plane for a portion of their length and a second plane angled upwardly or at an obtuse angle for the balance of their length so as to provide a support surface which can be disposed in parallelism with the roof surface.

It has further been found that this object can be achieved by providing a return leg which extends back toward the ladder from the ultimate end of the support legs and which terminates in a generally C-shaped bracket which fits inside the gutter and butts up against the back wall of the gutter thereby providing a further point of support for the ladder while protecting the gutter and keeping the ladder away from the outer wall thereof.

Accordingly, production of an improved gutter protection bracket of the character above described becomes the principal object of the invention with other objects thereof becoming more apparent upon a reading of the following brief specification considered and interpreted in view of the accompanying drawings.

BRIEF DESCRIPTION OF THE PREFERRED EMBODIMENTS

Figure 1:
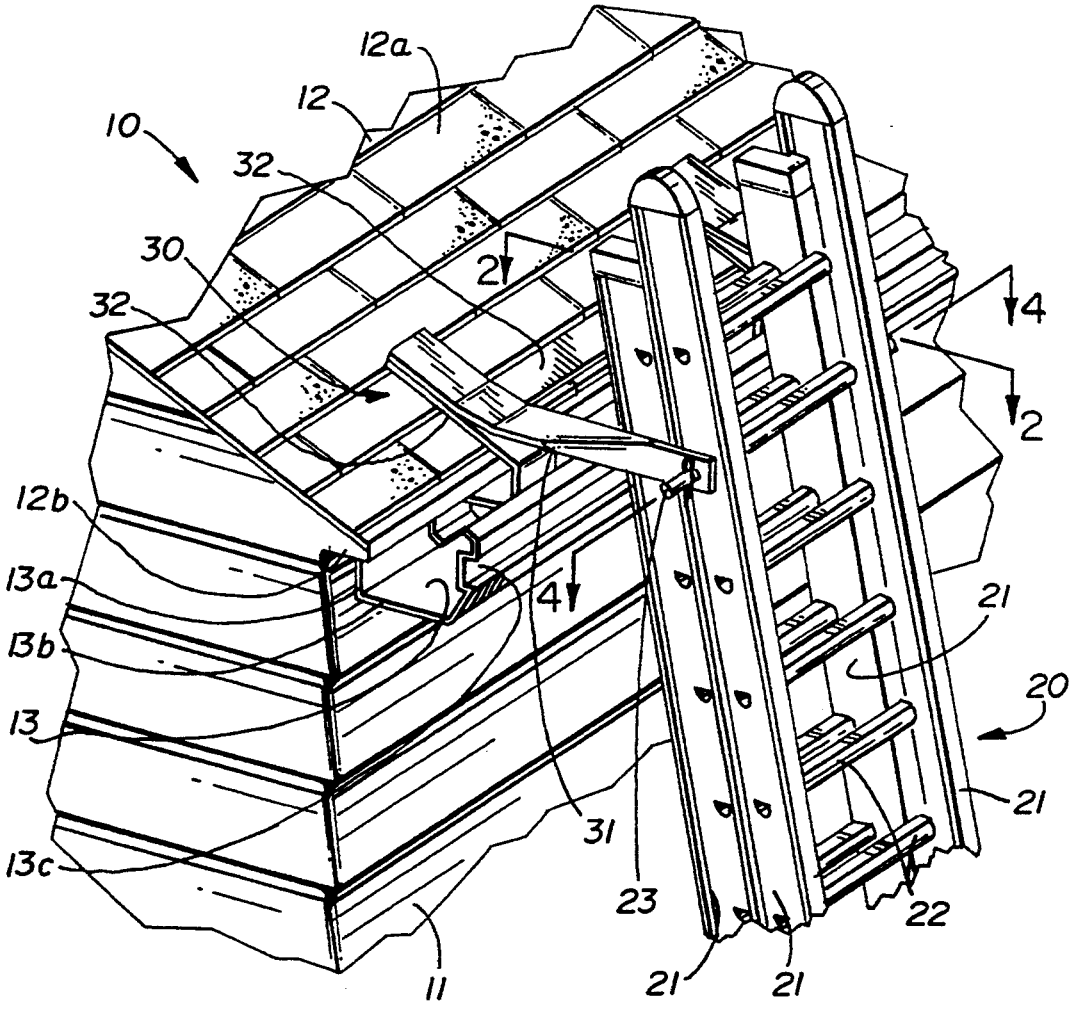
FIG. 1 is a perspective view of the improved gutter protecting ladder attachment in place on a ladder and with the ladder in place against a house or work surface.

Referring first to FIG. 1 of the drawings, it will be seen that the work surface or supporting surface is shown as a building generally designated by the numeral 10, in this instance, takes the form of a house, garage or other similar structure. To that end, it includes side walls 11 and a roof 12 with the roof 12 being shingled or tiled as indicated at **12*a* and having an overhang as indicated at 12*b***.

The building 10 carries an eaves trough or rain gutter generally designated by the numeral 13, which includes a rear wall **13*a*, which would normally be secured to the wall 11 of the building 10, a bottom wall 13*b* and a front wall 13*c*** so as to form, generally, a U-shaped cross section. These gutters are made of vinyl or aluminum and, generally, as previously noted, are fairly flimsy in construction and will not support a great deal of weight.

The ladder 20 is conventional in structure and includes opposed uprights 21, 21 and hollow rungs or steps 22, 22 mounted between the uprights 21, 21. One form of ladder having two flights is illustrated but, obviously, the invention is not intended to be limited to any such one form except that the rungs 22, 22 are preferably hollow as can readily been seen in FIG. 4 of the drawings for purposes which will be described below.

Figure 2:
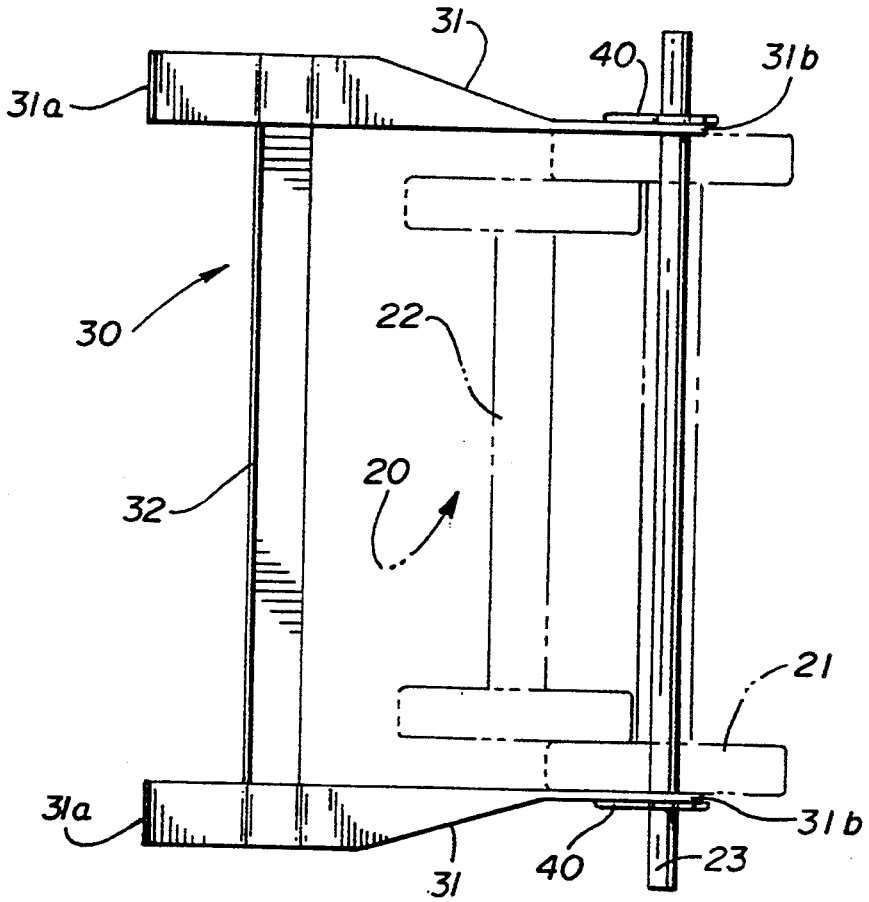
FIG. 2 is a top plan view taken along the line 2—2 of FIG. 1.
Figure 3:
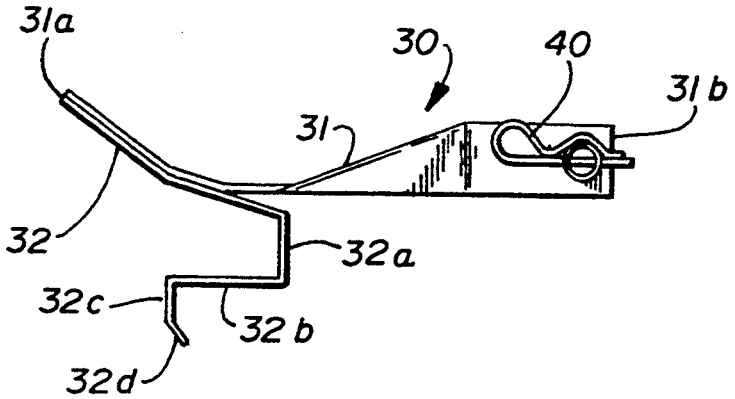
FIG. 3. is a side elevational view of the improved gutter protecting ladder attachment of the present invention.

The gutter protecting attachment is generally indicated by the numeral 30 in the drawings and details of its structure can probably best been seen in FIGS. 2 and 3 of the drawings.

Thus, the bracket 30 includes opposed support legs 31, 31 and a cross-brace 32 which extends between the opposed support legs and is secured thereto by welding or some other suitable expedient. The opposed support legs 31, 31 have a one end 31*a* and an opposed end 31*b* in each case.

Figure 4:
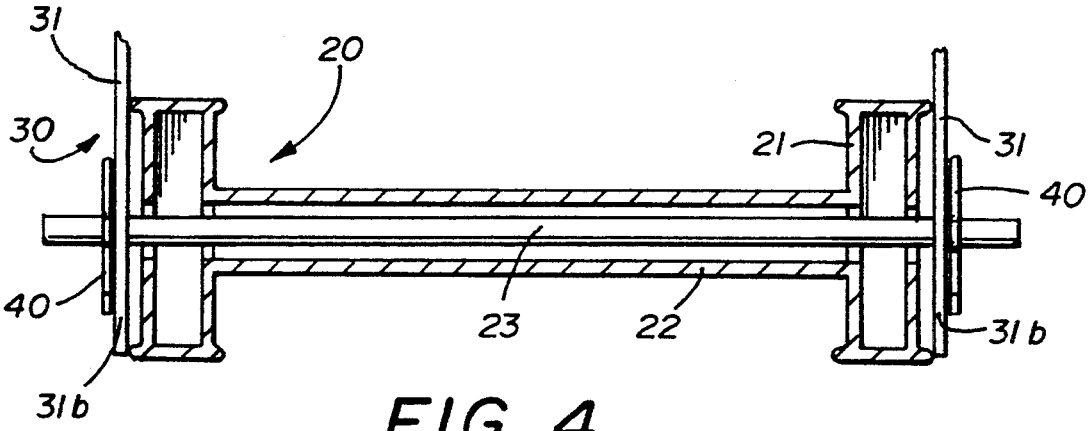
FIG. 4 is a sectional view taken along the line 4—4 of FIG. 1.

As can be seen clearly in FIGS. 2 and 4 of the drawings, a rod 23 can be passed through one of the hollow rungs with its ends extending beyond the uprights 21, 21 of the ladder 20. The one ends 31*b*, 31*b* of the legs 31, 31 have a suitable through aperture so as to be capable of being fit over the projecting ends of the rod 23 and can be secured in place by a cotter key 40 or other suitable securing means so as to prevent inadvertent disengagement between the rod 23 and the legs 31, 31. It will be noted that in the drawings, the attachment 30 is shown mounted on the second rung from the top of the ladder 20. One of the advantages of the invention is that the attachment could be mounted selectively on any of the rungs depending upon the work environment or situation and can also be transferred from one ladder to another if desired.

Referring again then to FIGS. 2 and 3 of the drawings, it will be seen that the support legs 31, 31 have a first portion extending from the one end 31*b* away from their points of attachment to the rod 23 and lie in a first plane which is essentially a vertical plane as illustrated. About the mid-point of each leg 31 will be noted that a second portion of each support leg begins to taper away from the horizontal and lies in a plane generally disposed at an obtuse angle to the first portion of the leg and presenting a flat surface for engaging the roof 12 of the structure. The angle is variable, but as can be seen in FIG. 1 of the drawings, the advantage of this arrangement is that the projecting end of the attachment is capable of lying flat on the roof surface which is generally slanted. This assures a firm surface to surface support for the ladder.

Still referring to FIG. 3 of the drawings, it will be noted that a return leg 32 is associated with each support leg and, essentially, amounts to doubling back beneath the projecting end of the support leg 31. This can be achieved by folding the support legs 31, 31 back on themselves or by welding a separate piece to the bottom of the support legs. Each of these return legs 32, 32 terminates in a support member which comprises a first portion 32*a*, disposed generally vertically, a second portion 32*b* extending back toward the building or away from the ladder and a third portion 32*c* against extending vertically and terminated in an angled lip 32*d*.

In use or operation of the improved gutter protecting attachment, the desired rung 22 for attachment purposes is selected and the rod 23 is passed through that rung with the opposed ends of the legs 31, 31 being secured hereto as clearly shown in all figures of the drawings.

The ladder can then be placed adjacent the building 10 as shown in FIG. 1. The support member structure, previously described in detail with respect to FIG. 3 of the drawings, can be slipped inside the gutter 13 with the third portion 32*c* of the member being placed against the rear wall 13*a* of the gutter and, essentially, being supported against the side wall 11 of the building. The projecting ends of the support legs 31, 31 will rest against the top of the building or the roof 12.

It will be noted that the legs 31, 31 may freely pivot about rod 23 so that it is believed that if the ladder 20 is placed at the suitable or recommended angel of 75°, no matter what the pitch of the roof is, the projecting ends of the support legs 31, 31 will be capable of being disposed in parallelism therewith.

It has thus been shown that the improved gutter protecting attachment is relatively simple to construct and install on the ladder but provides a firm support against both the roof and the side wall of the building to support the ladder and the person using it but, yet, keeps the ladder out of damaging engagement with the gutter, thereby protecting the same from inadvertent damage.

While a full and complete description of the invention has been set forth in accordance with the dictates of the Patent Statutes, it should be understood that modifications can be resorted to without departing from the spirit hereof or the scope of the appended claims.

What is claimed is:

1. A ladder support attachment for attachment to a ladder having at least one hollow rung, and engagement with a rain gutter and opposed uprights supporting the rung, the attachment comprising:

a) opposed, elongate, parallely disposed support legs;

b) an elongate support rod receivable in the hollow rung;

c) a cross brace interconnecting said support legs adjacent their one ends;

d) the opposed ends of said support legs being releasably attachable to the opposed ends of the support rod;

e) opposed return legs each with a first end connected to each support leg at said one ends and extending from said one ends thereof toward said opposed ends thereof; and f) engagement means carried by said opposed return legs at a second end thereof which extend toward said opposed ends for engagement with the interior of the rain rain gutter.

2. The support attachment of claim 1 wherein said support legs extend in a first plane from said opposed ends toward said one ends for a portion of their lengths and then in a second plane disposed at an angle with respect to said first plane for the remainder of their lengths to form said engagement means.

3. The support attachment of claim 1 wherein said opposed return legs extend in a first plane parallel to the plane of said support legs and terminate in a support member.

4. The support attachment of claim 3 wherein said support members each include a first portion depending from the plane of said return legs and a second portion extending from said first portion toward said one ends of said support legs.

5. The support attachment of claim 4 wherein said support members further include a third portion depending from said second portion and terminating in a lip disposed at an angle with respect to the plane of said third portion.

6. A ladder support attachment for attachment to a ladder having at least one hollow rung and opposed uprights supporting the rung, the attachment comprising:

a) opposed, elongate, parallely disposed support legs;

b) an elongate support rod receivable in the hollow rung;

c) a cross brace interconnecting said support legs adjacent their one ends;

d) the opposed ends of said support legs being releasably attachable to the opposed ends of the support rod;

e) opposed return legs associated with each support leg and extending from said one ends thereof toward said opposed ends thereof for engagement with the interior of a rain gutter;

f) said opposed return legs extending in a first plane parallel to the plane of said support legs and terminating in a support member; and g) said support members each including a first portion depending from the plane of said return legs and a second portion extending from said first portion toward said one ends of said support legs.

7. The support attachment of claim 6 wherein said support members further include a third portion depending from said second portion and terminating in a lip disposed at an angle with respect to the plane of said third portion.

* * * * *